US011634864B2

(12) United States Patent
Hämäläinen et al.

(10) Patent No.: US 11,634,864 B2
(45) Date of Patent: Apr. 25, 2023

(54) METHOD AND A SYSTEM FOR ADJUSTING S/NA-BALANCE OF A PULP MILL

(71) Applicant: Valmet Technologies Oy, Espoo (FI)

(72) Inventors: Risto Hämäläinen, Tampere (FI); Seppo Tuominiemi, Pirkkala (FI)

(73) Assignee: VALMET TECHNOLOGIES OY, Espoo (FI)

( * ) Notice: Subject to any disclaimer, the term of this patent is extended or adjusted under 35 U.S.C. 154(b) by 256 days.

(21) Appl. No.: 16/768,189

(22) PCT Filed: Dec. 20, 2018

(86) PCT No.: PCT/FI2018/050947

§ 371 (c)(1),
(2) Date: May 29, 2020

(87) PCT Pub. No.: WO2019/129922

PCT Pub. Date: Jul. 4, 2019

(65) Prior Publication Data

US 2020/0291574 A1 Sep. 17, 2020

(30) Foreign Application Priority Data

Dec. 29, 2017 (FI) ..... 20176188
Dec. 29, 2017 (FI) ..... 20176189

(51) Int. Cl.
*D21C 11/08* (2006.01)
*D21C 11/00* (2006.01)
*D21C 11/06* (2006.01)

(52) U.S. Cl.
CPC ..... *D21C 11/08* (2013.01); *D21C 11/0007* (2013.01); *D21C 11/0014* (2013.01); *D21C 11/0057* (2013.01); *D21C 11/06* (2013.01)

(58) Field of Classification Search
CPC ..... D21C 11/0007; D21C 11/06; D21C 11/08; D21C 11/0057
See application file for complete search history.

(56) References Cited

U.S. PATENT DOCUMENTS 3,331,732 A 7/1967 Venemark
4,137,134 A * 1/1979 Suominen ..... B01D 3/38 203/92

(Continued)

FOREIGN PATENT DOCUMENTS

CN 1079449 A 12/1993
CN 1125432 A 6/1996

(Continued)

OTHER PUBLICATIONS

Syed et al., Removal of hydrogen sulfide from gas stream using biological processes—A review, 2006, Canadian Biosystems Engineering, vol. 48, p. 2.1-2.14 (Year: 2006).*

(Continued)

*Primary Examiner* — Anthony Calandra
(74) *Attorney, Agent, or Firm* — Alston & Bird LLP

(57) ABSTRACT

The invention relates to a method and a system for adjusting S/Na-balance of a sulphate pulp mill, wherein a pulp mill CNCG stream containing sulphur compounds is first scrubbed with an aqueous scrubbing solution containing an alkaline agent, thereby producing an aqueous spent scrubbing solution containing sulphides, which is then oxidized in a bioreactor by means of sulphur-oxidizing microbes, thereby obtaining an aqueous suspension containing elemental sulphur from which the elemental sulphur can be separated as a precipitate and the residual solution may be used for replenishing the aqueous scrubbing solution.

18 Claims, 2 Drawing Sheets

(56) References Cited

U.S. PATENT DOCUMENTS

| | | | | |
|---|---|---|---|---|
| 4,225,381 | A * | 9/1980 | Ishikawa | C12N 1/145 422/4 |
| 5,196,069 | A | 3/1993 | Cullingford et al. | |
| 5,702,570 | A * | 12/1997 | Smith | D21C 11/00 162/30.11 |
| 5,976,868 | A | 11/1999 | Buisman | |
| 6,440,379 | B1 * | 8/2002 | Verrill | B01D 53/1412 422/171 |
| 2020/0385925 | A1 | 12/2020 | Hämäläinen | |

FOREIGN PATENT DOCUMENTS

| | | | |
|---|---|---|---|
| CN | 1218421 | A | 6/1999 |
| CN | 1226225 | A | 8/1999 |
| CN | 1228118 | A | 9/1999 |
| CN | 1798600 | A | 7/2006 |
| CN | 102413900 | A | 4/2012 |
| CN | 105498470 | A | 4/2016 |
| EP | 0958251 | B1 | 10/2002 |
| WO | WO-1992/010270 | A1 | 6/1992 |
| WO | WO-1994/029227 | A1 | 12/1994 |
| WO | WO-1996/030110 | A1 | 10/1996 |
| WO | WO-1997/043033 | A1 | 11/1997 |
| WO | WO-1998/002524 | A1 | 1/1998 |
| WO | WO-1998/004503 | A1 | 2/1998 |
| WO | WO-1999/057365 | A1 | 11/1999 |
| WO | WO-2000/020679 | A1 | 4/2000 |
| WO | WO-2010/115871 | A1 | 10/2010 |

OTHER PUBLICATIONS

Benschop, A., A. Janssen, A. Hoksberg, M. Seriwala, R. Abry and C. Ngai. 2002. The shell-Paques/THIOPAQ gas desulphurization process: Successful start up first commercial unit, http://www.paques.nl (Feb. 15, 2006) (Year: 2002).*

Office Action for Finnish Patent Application No. 20176188, dated Jul. 6, 2018, (6 pages), Finnish Patent and Registration Office, Helsinki, Finland.

Office Action for Finnish Patent Application No. 20176189, dated Jul. 26, 2018, (8 pages), Finnish Patent and Registration Office, Helsinki, Finland.

International Searching Authority, International Search Report and Written Opinion for International Application No. PCT/FI2018/050947, dated Apr. 5, 2019, (12 pages), European Patent Office, Rijswijk, Netherlands.

International Searching Authority, International Search Report and Written Opinion for International Application No. PCT/FI2018/050946, dated May 7, 2019, (16 pages), European Patent Office, Rijswijk, Netherlands.

Screen captures from YouTube video clip entitled "The THIOPAQ Process," Paques TV, 4 pages, [online], Jul. 28, 2015. [Retrieved from the Internet Jun. 18, 2018] <https://www.youtube.com/watch?v=c-x7vSZwSOs>.

* cited by examiner

METHOD AND A SYSTEM FOR ADJUSTING S/NA-BALANCE OF A PULP MILL

CROSS REFERENCE TO RELATED APPLICATIONS

This application is a National Stage Application, filed under 35 U.S.C. § 371, of International Application No. PCT/FI2018/050947, filed Dec. 20, 2018, which international application claims priority to and the benefit of both: Finnish Application No. 20176188, filed Dec. 29, 2017; and Finnish Application No. 20176189, filed Dec. 29, 2017; the contents of all of which as are hereby incorporated by reference in their entireties.

BACKGROUND

Related Field

The invention relates to a method and a system for adjusting S/Na-balance of a pulp mill. Some aspects of the invention relate to a method and a system for separating sulphur from a CNCG stream of a pulp mill. Some aspects of the invention relate to a method and a system for biological oxidation of sulphur compounds separated from a CNCG stream inside a pulp mill.

Description of Related Art

Industrial pulping processes, chemical pulping processes in particular, are utilized to remove hemicelluloses and lignin from the wood-based raw material in order to provide cellulose fibres. The chemical cooking process, sulphate cooking in particular, uses a combination of high temperature and pulping chemicals to break the chemical bonds of lignin, which is a natural biopolymer in the wood that binds the cellulose fibres together. In a sulphate cooking process, wood-based material is mixed in a digester with an aqueous solution of pulping chemicals, and then heated with steam. An example of a sulphate process is the Kraft process, wherein the main pulping chemicals are sodium hydroxide (NaOH) and sodium sulphide ($Na_2S$). The chemical cooking process separates cellulose fibres from the lignin and hemicellulose components, and produces spent cooking liquor, referred to as black liquor. This liquor containing the spent cooking chemicals and by-products is then concentrated and typically burned to recirculate the cooking chemicals. Recirculation of the cooking chemicals is typically referred to as the liquor cycle or the chemical recovery cycle of a pulp mill.

Due to tightened legislation relating to environmental protection, modern pulp mills need to circulate chemicals more carefully as well as try to diminish the accumulation of sulphur compounds in the environment. Conventional means for dealing with sulphur containing side streams formed at the pulp mill processes have been to dump the side streams as a fly ash or to recirculate the sulphur containing side streams to other processes for manufacture of industrial chemicals. One example for sulphur recovery is the combustion of malodorous gases, which are formed as a by-product of the pulp manufacturing process. The combustion of the malodorous gases produces flue gas containing sulphur oxides, which may be recovered and further used to manufacture for example sulphuric acid. Sodium bisulphite, dithionite and gypsum are other examples of possible products which may be manufactured from the sulphur containing side streams of a pulp mill. However, the refining of pulp mill flue gas or sulphur containing side streams to more valuable chemicals requires massive capital investments and separate chemical plants. The refining may further be problematic from the environmental perspective. Furthermore, such investments are time consuming and may be difficult to retrofit to already existing processes at conventional pulp mills.

Sulphur is a critical chemical in the chemical cooking process of a sulphate pulp mill and needs to be removed from and replenished to the chemical recovery cycle on a continuous basis. A particular downside related to the conventional ways for recovering sulphur from the pulp mill is the concomitant loss of sodium from the chemical cooking process, which is typically recovered together with the sulphur. This leads to loss of two critical elements in the cooking chemicals, which is undesirable for the S/Na-balance of the pulp mill. It is therefore a constant dilemma how the total sulphur content of the chemical recovery cycle could be reduced and how the S/Na-balance of the pulp mill could be improved in view of stricter legislation. The accumulation of sulphur into the chemical recovery cycle is a continuous challenge for the efficient operation of the pulp mill. Thus, there is a need for a cost-effective and environmentally friendly method and system for controlling the S/Na-balance of a pulp mill that are easier to implement on an already existing process of a conventional pulp mill.

BRIEF SUMMARY

The above disclosed problems may be addressed by providing a method and a system which enables adjustment of S/Na-balance of a pulp mill by separation of sulphur compounds from a CNCG stream of a pulp mill as sulphides, and oxidation of sulphides into elemental sulphur with microbes. An advantage is that adjusting the S/Na-balance of the pulp mill may be implemented in a simpler and faster manner. A further advantage is that by this way, sulphur may be recovered without losing sodium. This reduces the need for adding make-up NaOH in order to adjust the sulphidity of the pulp mill, thereby lowering the costs and enabling avoidance of unnecessary use of chemicals. Thus, adjusting S/Na-balance of the pulp mill in a cost-efficient and environmentally friendly manner is enabled.

Concentrated non-condensable gases, hereafter referred to as CNCGs, are odorous gases that are formed in pulp mill processes. CNCGs contain sulphur compounds, wood organics, air and water vapour. The sulphur compounds of the CNCGs may originate for example from digesters, cooking and evaporators. Typically, the concentrated gases are collected and combusted either in the pulp mill recovery boiler, in a separate furnace or in a lime kiln. Malodorous gases formed per year in a pulp mill may contain several million tons of elemental sulphur. The most part of this is represented by CNCGs. Thus, a pulp mill CNCG stream is an attractive source material for adjusting S/Na-balance of a pulp mill by separation and recovery of sulphur compounds.

Conventional ways for treating sulphur compounds are fly ash dumping and the production of useful chemicals, such as $NaHSO_3$ or $H_2SO_4$. The produced chemicals may be used either at the pulp mill, for example in pulp bleaching, or the produced chemicals may be used in external processes, outside the pulp mill. One problem related to the conventional ways for recovering sulphur from the pulp mill is loss of sodium together with recovered sulphur. Thus, there is a need for a method and a system by which sulphur may be recovered without losing sodium. This is accomplished by recovering sulphur in its elemental form. Furthermore, when sulphur is removed from the pulp mill CNCG stream as elemental sulphur, the material is in a very compact and dense form, which is easy to store on-site or transport in large amounts to already existing chemical plants for chemical production. The elemental sulphur further is in a form that can easily be used in various chemical reactions. Biological oxidation of a pulp mill CNCG stream, which stream has been treated into the form of an aqueous solution comprising sulphides, thus provides a cost-effective and environmentally friendly method for recovering and recycling sulphur.

Producing the elemental sulphur with biological oxidation by microbes is cost-efficient, space-saving and technically simple solution. CNCG streams, specific in their composition, constitute a part of the sulphur balance system of a pulp mill. CNCGs released during the pulping process are noxious and have a very low threshold of odour detectability. CNCGs vented to atmosphere may cause injuries, environmental damage and odour nuisances to the surrounding community. Added to the toxic and corrosive properties of CNCGs, they are explosive as well. Thus, implementing as such technically simple solution of adjusting the S/Na-balance of a pulp mill by biologically producing elemental sulphur from the CNCG streams in a pulp mill environment requires that several aspects have to be taken into account.

According to an aspect of the invention, a pulp mill CNCG stream containing sulphur compounds is first scrubbed in a scrubber with an aqueous scrubbing solution containing an alkaline agent. The sulphur compounds react with the alkaline agent thus producing an aqueous spent scrubbing solution containing sulphides, such as $Na_2S$ and NaHS. The sulphides, when reacted, transfer themselves from the gaseous phase into the liquid phase, such that a selective sulphide conversion may be obtained. The aqueous spent scrubbing solution containing sulphides is then oxidized biologically in a bioreactor by means of sulphur-oxidizing microbes, thereby forming elemental sulphur. The elemental sulphur may then be recovered. When the separation of sulphur compounds is implemented from a CNCG stream of a pulp mill with a separate bioreactor, the method is easier to implement on an already existing process of a conventional pulp mill.

Therefore, there is provided a method for adjusting S/Na-balance of a sulphate pulp mill, which method comprises

- providing a pulp mill CNCG stream containing sulphur compounds into a scrubber,
- scrubbing the pulp mill CNCG stream containing sulphur compounds in the scrubber with an aqueous scrubbing solution containing an alkaline agent, whereby at least some of the sulphur compounds react with the alkaline agent, thereby producing a CNCG stream derivate and an aqueous spent scrubbing solution containing sulphides,
- introducing the aqueous spent scrubbing solution containing sulphides into a bioreactor located downstream of the scrubber,
- oxidizing the aqueous spent scrubbing solution containing sulphides in the bioreactor biologically in an oxidizing reaction by means of sulphur-oxidizing microbes, thereby obtaining an aqueous suspension containing elemental sulphur,
- separating the elemental sulphur from the aqueous suspension in a sulphur separation unit located downstream of the bioreactor, thereby obtaining a residual solution and a precipitate containing the elemental sulphur.

Objects according to the invention are further described in the appended claims.

Figure 1:
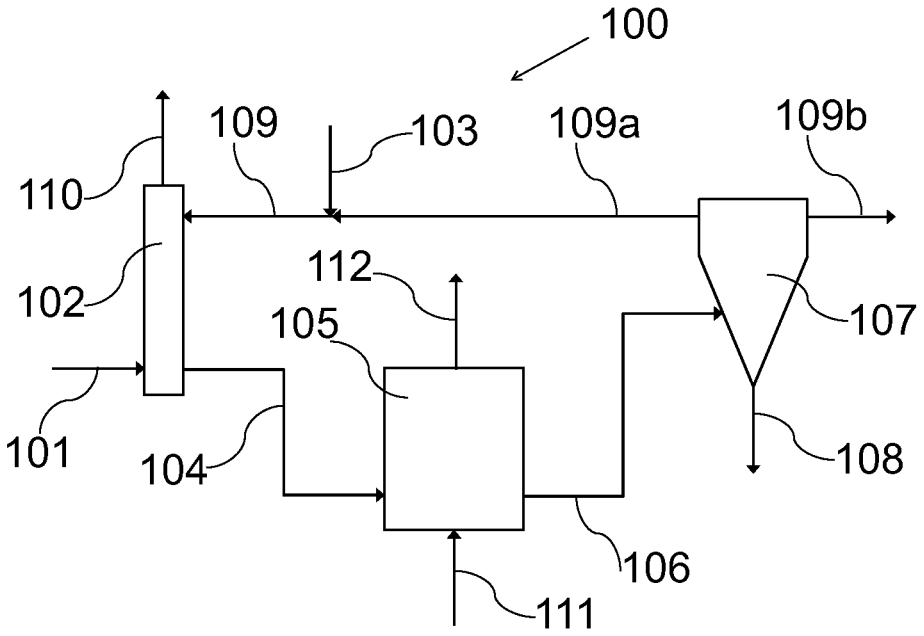
FIG. 1 illustrates, by way of an example, a process diagram of a system configured to adjust S/Na-balance of a pulp mill.

The figures are schematic. The figures are not in any particular scale.

DETAILED DESCRIPTION OF VARIOUS EMBODIMENTS

The term "scrubber" refers to an air pollution control device which is used to remove particulates or compounds from a pulp mill exhaust gas stream. An aqueous solution may be introduced into the scrubber to collect unwanted pollutants from a gas stream into an aqueous spent scrubbing solution.

The term "concentrated non-condensable gas" or CNCG refers to odorous sulphur containing compounds generated as by-products of a pulping process, which are captured and eliminated to meet environmental standards. A non-condensable gas is a residue which remains after a captured gas has been cooled and the heavier components have been condensed out. Concentrated non-condensable gases are formed typically at the digester and evaporator areas of a pulp mill, for example when black liquor is concentrated to increase the dry-solids content for combustion. CNCG comprises Total Reduced Sulphur (TRS). CNCG may comprise for example hydrogen sulphide ($H_2S$), methyl mercaptan ($CH_3SH$), dimethyl sulphide ($CH_3SCH_3$) and dimethyl disulphide ($CH_3SSCH_3$). Table 1 below presents examples of CNCG analyses from pulp mills A, B, and C. As evident from Table 1, the amount of various sulphur containing compounds in a GNGC stream may vary between different pulp mills. However, the amount of sulphur containing compounds is considerable in all of the pulp mills of table 1.

TABLE 1

Examples of CNCG analyses from pulp mills A, B and C. The symbol '*' indicates that the component has either not been analysed or has been below the detection level of the analysis.

| Component | A (ppm) | B (ppm) | C (ppm) |
|---|---|---|---|
| $H_2S$ | 50000 | 81300 | 81300 |
| $CH_3SH$ | 80900 | 110000 | 188300 |
| $CH_3SCH_3$ | 22000 | 50000 | 116000 |
| $CH_3SSCH_3$ | 800 | 30000 | 3000 |
| $C_{10}H_{16}$ | 1900 | * | * |
| $CH_3OH$ | * | * | * |
| $O_2$ | * | * | * |
| $NH_3$ | * | * | * |
| $H_2O$ | 20000 | 330000 | * |
| $CO_2$ | * | * | * |

The term "efficiency" refers to a quantitative ratio of output to the total input. Unless otherwise stated, efficiency in this context is calculated as a percentage of the theoretical maximum, which the given total input quantities could yield. In other words, efficiency is expressed as a percentage of the result that could ideally be expected.

The term "mass flow rate" refers to a mass of a substance passing per unit of time.

The term "aerating" refers to supplying oxygen or air. Aeration is a process by which air is circulated through, mixed with or dissolved in a liquid, thereby allowing oxygen to be transferred into the liquid, such as an aqueous solution.

Within the context of this specification, the term "sulphides" refers to compounds or substances comprising $HS^-$ or $S^{2-}$ entities. Those compounds or substances include, for example, NaHS and $Na_2S$, as well as their hydrates.

A large amount of chemicals is used in a chemical pulp production, and recovery and re-use of these chemicals is required. The process for manufacturing bleached chemical pulp typically comprises pulping, washing, screening, bleaching, and cleaning stages. The main process units in the chemical recovery system of a pulp mill are the evaporation of the black liquor, burning of the evaporated liquors in a recovery boiler and causticizing, including lime generation.

The recovery boiler is used to recover the cooking chemicals. When burnt, the cooking chemicals form a molten 'smelt' at the bottom of the recovery boiler. The smelt may be dissolved into a liquid. Thus formed liquid may be denoted as green liquor due to a characteristic green color. Green liquor may be used to prepare white liquor for the pulping process. The recycling of these spent cooking chemicals is denoted as a liquor cycle. The liquor cycle is designed to recover the chemicals used in the pulping. In particular, the recovery boiler aims to recover sodium carbonate ($Na_2CO_3$) and sodium sulphide ($Na_2S$). The green liquor is clarified and causticized with lime, in which process $Na_2CO_3$ is converted to NaOH. Besides NaOH and $Na_2S$, white liquor also comprises other sodium salts, such as sodium sulphate ($Na_2SO_4$), and small amounts of sulphites and chlorides. Volatile sulphur compounds, however, cannot be recovered by the liquor cycle itself.

In a chemical pulp production cooking is used for recovering fibres from chips in a digester by using chemicals and heat in order to remove fibre binding lignin and, in addition, to remove wood extractives which may later cause foaming and precipitants in the process. Therefore, chemicals which dissolve as much lignin and as little cellulose as possible are typically used in the pulping process. Typically, the process for manufacturing bleached chemical pulp comprises pulping, washing, screening, bleaching, and cleaning stages. Nowadays sulphate cooking, also called as Kraft cooking or pulping, which uses a mixture of sodium hydroxide (NaOH) and sodium sulphide ($Na_2S$), is the most commonly used pulp production method. The cooking process may be based on batch cooking or continuous cooking comprising a digester or several digesters. The chemicals required for this process are used in a mixture denoted as white liquor.

In pulping, sodium sulphide ($Na_2S$) and sodium hydroxide (NaOH) of white liquor react with water forming hydrosulphide ($HS^-$) and hydroxyl ($OH^-$) groups according to equations 1 and 2.

$$Na_2S+H_2O \rightarrow 2Na^+ + HS^- + OH^- \quad \text{(Equation 1)}$$

$$NaOH \rightarrow Na^+ + OH^- \quad \text{(Equation 2)}$$

As a result of the pulping process, black liquor is formed. The pulp coming from the digester contains both fibres and spent cooking liquor (black liquor). The black liquor is removed from the pulp in the subsequent washing. The spent cooking chemicals together with the dissolved organic substances are washed away from the fibres in the brown stock washing stages.

The black liquor comprising the spent cooking liquor optionally together with counter-current washing liquor, is evaporated, and the evaporation results into formation of concentrated black liquor. The black liquor may be concentrated in an evaporation plant to a dry-solids content (DS) of 65-75%. The black liquor may be concentrated to over 80% DS by using heat treatment and pressurised evaporation. In heat treatment some of the combustible material separates as non-condensable gas (NCG), that contains reduced sulphur compounds.

Condensates from the black liquor evaporators and the cooking plant typically comprise TRS, methanol and other volatile organic compounds. The condensates may be treated in a stripper column. In the stripper column, $H_2S$ contained by the condensate may be recovered. The stripper column may be integrated with the black liquor evaporation. The concentrated black liquor may be combusted in the recovery boiler.

The handling and combustion of black liquor having a high sulphur content releases sulphur dioxide and malodorous gases comprising reduced sulphur compounds, such as hydrogen sulphide ($H_2S$), methyl mercaptan ($CH_3SH$), dimethyl sulphide ($CH_3SCH_3$) and dimethyl disulphide ($CH_3SSCH_3$).

The malodorous gases may be divided into strong (concentrated) and weak (diluted) gases. Weak malodorous gas typically refers to a gas having a sulphur concentration of less than 0.5 $g/m^3$. The sulphur concentration of a strong malodorous gas typically is above 5 $g/m^3$. The concentrated gases may originate from digester, evaporation plant and condensate stripper. The diluted gases, for one, may originate for example from chip-pre-steaming, screening, pulp washing, smelt dissolver and ventilation of various tanks.

Sulphur balance control is important in a pulp mill. As sulphur is introduced to the cooking process, sulphur also has to be removed from the chemical recovery cycle in order to avoid excessive sulphur content in the cycle. Excessive sulphur content as well as unnecessary low sulphur content in the chemical recovery cycle may cause operational problems resulting for example in poor pulping liquor quality, increased mill energy consumption, and decreased mill production capacity. S/Na-balance of a pulp mill is related to sulphidity. Sulphidity is a percentage value of a ratio between amounts of $Na_2S$ and active alkali in the pulp mill white liquor. Active alkali refers to NaOH and $Na_2S$. Sulphidity may typically vary between 20-50%. Sulphidity of the pulp mill may be maintained at a desired level by adding make-up NaOH to the chemical recovery cycle. This, however, causes extra costs and requires unnecessary use of chemicals. Equation 3 may be used to express sulphidity of a pulp mill. The amounts of $Na_2S$ and NaOH may be expressed in grams of NaOH equivalents, or in percentages of dry wood. Sulphidity of a pulp mill may be determined using standards NaOH SCAN-N 30:85 and $Na_2S$ SCAN-N 31:94.

$$\frac{[Na_2S]}{[NaOH + Na_2S]} \cdot 100 \quad \text{(Equation 3)}$$

The malodorous gases may contain in total 1.5-10 kg of elemental sulphur per air-dry ton of pulp (S/Adt), depending on the sulphidity of the pulp mill. Generally, the elemental sulphur content may be between 3-4 kg/Adt. Thus, in an exemplary pulp mill that produces one million air-dry tons of pulp per year, the malodorous gases formed per year may typically contain 3-4 million tons of elemental sulphur.

Typically, the concentrated gases are collected and combusted either in the recovery boiler, in a separate furnace or in a lime kiln. Typically employed ways for removing or recovering sulphur are fly ash dumping, production of $NaHSO_3$ and its utilization in bleaching, as well as onsite $H_2SO_4$ production.

The current specification discloses adjustment of S/Na-balance of a pulp mill by a method and a system for removing sulphur compounds from the chemical recovery cycle of a pulp mill, as well as for processing the sulphur compounds into elemental sulphur, which is of high intrinsic value. Chemically, sulphur reacts with almost all elements except for some noble metals and the noble gases. Elemental sulphur may be used as a precursor to other chemicals, such as sulphuric acid. Further, the disclosed method and system enable recovery of sulphur without losing sodium at the same time. The recovery of sulphur without sodium may be used to adjust the S/Na-balance of the pulp mill.

Figure 2:
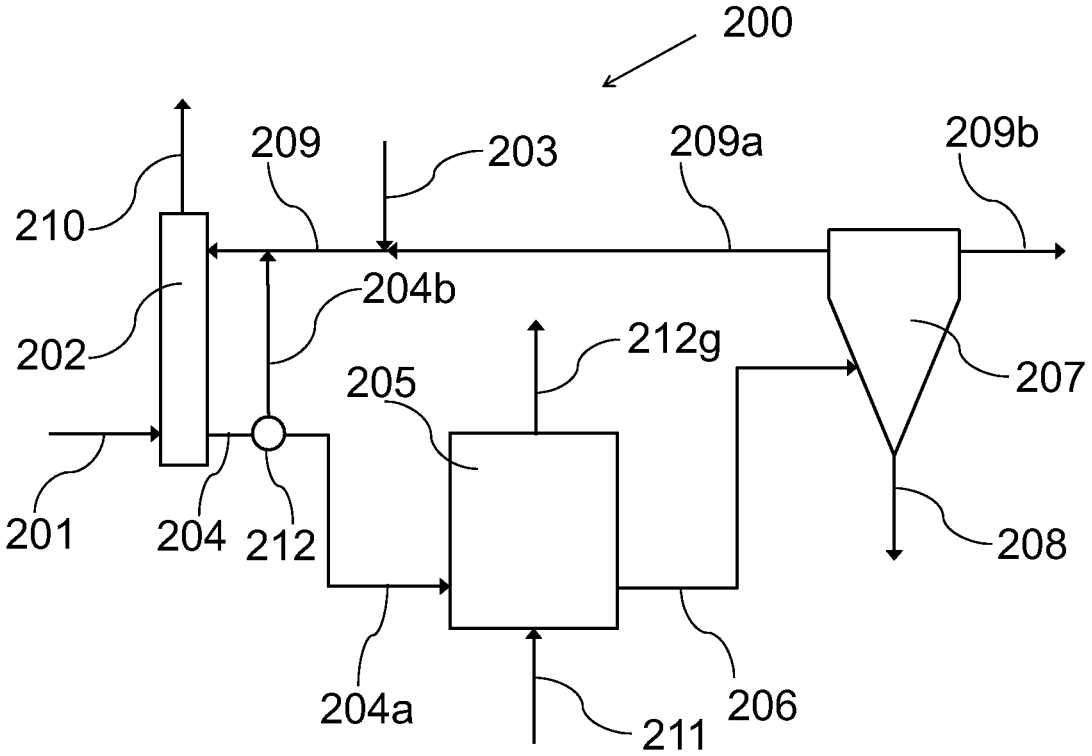
FIG. 2 illustrates, by way of an example, a process diagram of another system configured to adjust S/Na-balance of a pulp mill.

FIGS. 1 and 2 illustrate, by way of an example, a system 100, 200 for adjusting S/Na-balance of a sulphate pulp mill. The system 100, 200 comprises a scrubber 102, 202, a bioreactor 105, 205 located downstream of the scrubber 102, 202 and a sulphur separation unit 107, 207 located downstream of the bioreactor 105, 205.

In a method implementable by the system 100, 200, a pulp mill CNCG stream 101, 201 containing sulphur compounds is provided into the scrubber 102, 202. The pulp mill CNCG stream 101, 201 may originate from evaporation, cooking and/or foul condensate stripping. The pulp mill CNCG stream 101, 201 prior to entering the scrubber 102, 202 may have a temperature above room temperature, preferably in the range of 40 to 50° C. The pulp mill CNCG stream 101, 201 may contain at least one or more of the following: $H_2S$, $CH_3SH$, $CH_3SCH_3$, $CH_3SSCH_3$.

In an exemplary pulp mill that produces one million air-dry tons of pulp per year, a total mass flow rate of the pulp mill CNCG stream 101, 201 may be about 400 kg of elemental sulphur per hour. The average mass flow rates for the components of a pulp mill CNCG stream may be for example for dimethyl sulphide about 240 kg/h, dimethyl disulphide about 50 kg/h, hydrogen sulphide about 140 kg/h and methyl mercaptan about 195 kg/h. The mass flow rate values for the gas components may be calculated from the concentrations determined using following methods: Method 16—Semicontinuous Determination of Sulfur Emissions From Stationary Sources; Method 16A—Determination of Total Reduced Sulfur Emissions From Stationary Sources (Impinger Technique); Method 16B—Determination of Total Reduced Sulfur Emissions From Stationary Sources; Method 16C—Determination of Total Reduced Sulfur Emissions From Stationary Sources.

Figure 3:
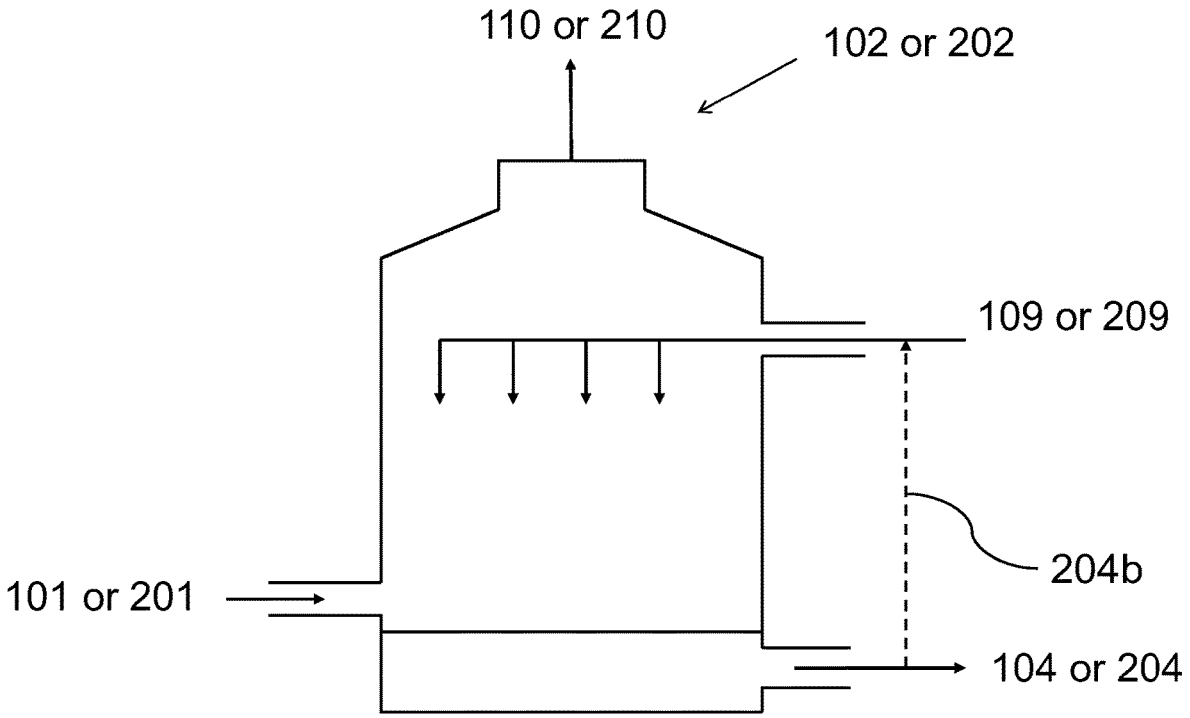
FIG. 3 illustrates, by way of an example, a scrubber configured to separate sulphur from a sulphate pulp mill CNCG stream.

FIG. 3 illustrates, by way of an example, the scrubber 102, 202 with reference to FIGS. 1 and 2. In the scrubber 102, 202 the pulp mill CNCG stream 101, 201 containing sulphur compounds is scrubbed with an aqueous scrubbing solution 109, 209. The pH of the aqueous scrubbing solution 109, 209 may be adjusted with an alkaline agent. A stream 103, 203 comprising the alkaline agent may be configured to feed the alkaline agent to the aqueous scrubbing solution 109, 209. As the alkaline agent for example NaOH solution or oxidized white liquor may be utilized. The pH of the aqueous scrubbing solution 109, 209 may be above 8. Preferably, the pH of the aqueous scrubbing solution 109, 209 is above 11.5. The pH of the aqueous scrubbing solution 109, 209 may be in the range of 12 to 14. The efficiency of scrubbing improves with higher pH. Methyl mercaptan, for example, gets more efficiently scrubbed at higher pH. When NaOH is utilized as the alkaline agent, the mass flow rate of NaOH fed into the aqueous scrubbing solution 109, 209 may be 8.2 kg per hour in an exemplary pulp mill that produces one million air-dry tons of pulp per year.

In the scrubber 102, 202, intensive contact between the pulp mill CNCG stream 101, 201 and the aqueous scrubbing solution 109, 209 is enabled. At least some of the sulphur compounds of the pulp mill CNCG stream 101, 201 react with the alkaline agent, thereby forming sulphides, such as $Na_2S$ and NaHS. A CNCG stream derivate 110, 210 and an aqueous spent scrubbing solution 104, 204 containing sulphides are produced in the scrubber 102, 202. A $Na_2S$/NaHS mixture ratio of the aqueous spent scrubbing solution 104, 204 is dependent on the pH of the aqueous spent scrubbing solution 104, 204. Advantageously, the system 100, 200 may comprise at least one conduit configured to direct CNCG stream derivate 110, 210 from the scrubber 102, 202 into the sulphate pulp mill recovery boiler. This enables that at least some of the CNCG stream derivate 110, 210 from the scrubber 102, 202 may be directed into the sulphate pulp mill recovery boiler, thereby enabling recirculation of chemicals from the CNCG stream derivate 110, 210 into the chemical recovery cycle of the sulphate pulp mill. Thus the method and the system which enables adjustment of S/Na-balance of a pulp mill by separation of sulphur compounds from a CNCG stream of a pulp mill as sulphides, and oxidation of sulphides into elemental sulphur with microbes may be further enhanced by introducing the CNCG stream derivate 110, 210 back into the chemical recovery cycle of the sulphate pulp mill.

The scrubber 102, 202 may be an absorption tower of a packed bed column type. The scrubber 102, 202 provides a straight contact area between a gas and a liquid. Within context of this specification, it is of importance that air must not be allowed to enter the scrubber 102, 202, as the CNCGs are highly flammable.

The CNCG stream derivate 110, 210 may comprise $H_2S$ less than 5 vol-% and/or $CH_3SH$ less than 25 vol-%. The CNCG stream derivate 110, 210 may be forwarded to a processing of strong malodorous gases. The processing of strong malodorous gases may comprise burning of the gases for example in a recovery boiler.

Figure 4:
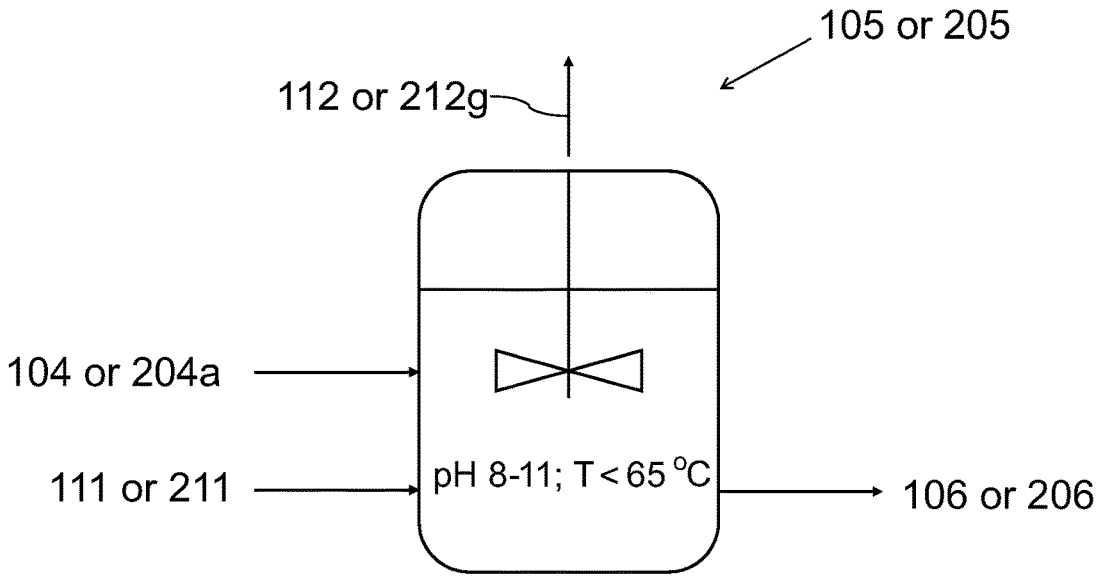
FIG. 4 illustrates, by way of an example, a bioreactor configured to separate sulphur from a sulphate pulp mill CNCG stream.

FIG. 4 illustrates, by way of an example, the bioreactor 105, 205 with reference to FIGS. 1 and 2. The aqueous spent scrubbing solution 104, 204*a* containing sulphides is introduced into the bioreactor 105, 205. The temperature of the aqueous spent scrubbing solution 104, 204*a* prior to entering the bioreactor 105, 205 is above room temperature. Preferably, the temperature of the aqueous spent scrubbing solution 104, 204*a* is in the range of 40 to 60° C. prior to entering the bioreactor 105, 205. In the bioreactor 105, 205 the aqueous spent scrubbing solution 104, 204*a* containing sulphides is oxidized biologically in an oxidizing reaction. The oxidizing takes place by means of sulphur-oxidizing microbes.

According to an embodiment illustrated in FIG. 2, at least some of the aqueous spent scrubbing solution 204*b* is recirculated by a pump 212 back to the scrubber 202. Thus, the aqueous spent scrubbing solution 204 is divided into two portions 204*a* and 204*b*. By this arrangement, the sulphur compounds of the pulp mill CNCG stream 201 are more efficiently converted into sulphides.

The sulphur-oxidizing microbes may be autotrophic, heterotrophic or mixotrophic aerobic bacteria. The sulphur-oxidizing microbes may be alkaliphilic. The sulphur-oxidizing microbes may include for example the bacteria of the genera *Thiobacillus* and *Thiomicrospora*. The bacteria capable of oxidizing sulphide to elemental sulphur may be obtained for example from geothermal springs, oceanic geothermal vents, sulphidic cave systems, sulphide-rich industrial sites, sewage sludge, soil, salt marshes, soda lakes and cold springs. Alkaliphilic sulphur-oxidizing bacteria such as *Thioalkalimicrobium, Thioalkalivibrio* and *Thioalkalispira* may be isolated from soda lakes. They may be halophilic or halotolerant to varying degrees. The sulphur-oxidizing microbes may have at least one of the following properties: pH optimum above 9, usually below 10.5, in particular around 9.5; capability of oxidizing at least $H_2S/HS^-$; growth over a temperature range of 10-65° C.; tolerance for NaCl and sodium carbonates.

The bioreactor 105, 205 may be aerated with a gas 111, 211 comprising air and/or weak malodorous gas from the pulp mill. In the oxidizing reaction most of the sulphides of the aqueous spent scrubbing solution 104, 204*a* get oxidized into elemental sulphur. The efficiency of the oxidizing reaction may be equal to or more than 95%. As the chemical stability of the elemental sulphur produced decreases with increasing pH and temperature, the temperature inside the bioreactor should not exceed 65° C. The pH of a reaction medium inside the bioreactor 105, 205 may be between 8-11. By aerating the bioreactor 105, 205 with weak malodorous gas the pH of the reaction medium may be lowered. By this way, use of somewhat higher pH than what is optimal for the bioreactor 105, 205, in the scrubber 102, 202, may be compensated by aerating the bioreactor 105, 205 with weak malodorous gas capable of lowering the pH of the reaction mixture. The bioreactor 105, 205 may be a mixing reactor. According to an embodiment, the system may contain more than one bioreactor 105, 205. The bioreactors may be arranged in parallel.

The oxidizing reaction yields an aqueous suspension 106, 206 containing elemental sulphur. The oxidizing reaction also yields a gas stream 112, 212*g*.

The gas stream 112, 212*g* may be forwarded from the bioreactor 105, 205 to a processing of processing of weak malodorous gases of the pulp mill. The processing of weak malodorous gases may be performed in the recovery boiler, in such a way that the weak malodorous gases are fed into the combustion air of the recovery boiler. Advantageously, the system 100, 200 may comprise at least one conduit configured to direct gas stream 112, 212*g* from the bioreactor 105, 205 into the sulphate pulp mill recovery boiler. This enables that at least some of the gas stream derivate 112, 212*g* from the bioreactor 105, 205 may be directed into the sulphate pulp mill recovery boiler, thereby enabling recirculation of chemicals from the gas stream 112, 212*g* into the chemical recovery cycle of the sulphate pulp mill. Thus the method and the system which enables adjustment of S/Na-balance of a pulp mill by separation of sulphur compounds from a CNCG stream of a pulp mill as sulphides, and oxidation of sulphides into elemental sulphur with microbes, may be further enhanced by introducing chemicals from the gas stream 112, 212*g* back into the chemical recovery cycle of the sulphate pulp mill.

The aqueous suspension 106, 206 containing elemental sulphur from the bioreactor 105, 205 is conducted to a sulphur separation unit 107, 207. In the sulphur separation unit 107, 207 the elemental sulphur is separated from the aqueous suspension 106, 206. A residual solution 109*a*, 109*b*, 209*a*, 209*b* and a precipitate 108, 208 containing the elemental sulphur are thereby obtained. The sulphur separation unit 107, 207 may be a conical separator. The separation may be performed for example by filtration, settling or flocculation. In an exemplary pulp mill that produces one million air-dry tons of pulp per year the amount of elemental sulphur produced may be 166 kg per hour. The mass flow rate of the residual solution 109*a*, 109*b*, 209*a*, 209*b* with respect to sulphur may be 3.3 kg per hour.

The embodiment illustrated in FIG. 2, in which at least some of the aqueous spent scrubbing solution 204*b* is recirculated by a pump 212 back to the scrubber 202, enables use of a smaller sulphur separation unit 207 compared to the system disclosed in FIG. 1. As the sulphur compounds of the pulp mill CNCG stream 201 are more efficiently converted into sulphides, the volume of the aqueous suspension 206 containing elemental sulphur may be smaller, and thus a smaller unit is needed for separation of the residual solution 209*a*, 209*b* and the precipitate 208 containing the elemental sulphur.

From the sulphur separation unit 107, 207, at least some of the residual solution 109*a*, 209*a*, from which the precipitate 108, 208 has been separated, may be directed back into the scrubber 102, 202 for replenishing the aqueous scrubbing solution 109, 209. Thus, the possible un-oxidized sulphur compounds of the residual solution 109*a*, 209*a* may be directed back to the bioreactor 105, 205 for oxidizing. Further, recirculating the liquid diminishes the need for fresh water and reduces the unnecessary use of the valuable natural resources. The residual solution 109*b*, 209*b* may be fed back to the chemical recovery cycle of the pulp mill.

Many variations of the method and system will suggest themselves to those skilled in the art in light of the description above. Such obvious variations are within the full intended scope of the appended claims.

The invention claimed is:

1. A method for adjusting S/Na-balance of a sulphate pulp mill, the method comprising:

providing a sulphate pulp mill producing a pulp mill CNCG stream containing sulphur compounds and a gas comprising weak malodorous gas;

transporting, via one or more conduits, the pulp mill CNCG stream containing sulphur compounds from the sulphate pulp mill into a scrubber, scrubbing the pulp mill CNCG stream containing sulphur compounds in the scrubber with an aqueous scrubbing solution containing an alkaline agent, whereby at least some of the sulphur compounds react with the alkaline agent, thereby producing a CNCG stream derivate and an aqueous spent scrubbing solution containing sulphides, introducing the aqueous spent scrubbing solution containing sulphides into a bioreactor located downstream of the scrubber, oxidizing the aqueous spent scrubbing solution containing sulphides in the bioreactor biologically in an oxidizing reaction by means of sulphur-oxidizing microbes, thereby obtaining an aqueous suspension containing elemental sulphur, separating the elemental sulphur from the aqueous suspension in a sulphur separation unit located downstream of the bioreactor, thereby obtaining a residual solution and a precipitate containing the elemental sulphur, and aerating the bioreactor with the gas comprising the weak malodorous gas, the weak malodorous gas being directed via at least one conduit connected to the pulp mill, from the pulp mill to the bioreactor.

2. The method according to claim 1, further comprising directing at least some of the residual solution, from which the precipitate has been separated, back into the scrubber for replenishing the aqueous scrubbing solution.

3. The method according to claim 1, further comprising directing at least some of the aqueous spent scrubbing solution by a pump back into the scrubber for re-scrubbing.

4. The method according to claim 1, wherein the pulp mill CNCG stream contains at least one or more of the following: $H_2S$, $CH_3SH$, $CH_3SCH_3$, $CH_3SSCH_3$.

5. The method according to claim 1, wherein the pulp mill CNCG stream prior to entering the scrubber has a temperature above room temperature.

6. The method according to claim 5, wherein the temperature is in the range of 40 to 50° C.

7. The method according to claim 1, wherein NaOH is added to the aqueous scrubbing solution.

8. The method according to claim 1, wherein the pH of the aqueous scrubbing solution is above 8.

9. The method according to claim 1, wherein the pH of the aqueous scrubbing solution is above 11.5.

10. The method according to claim 1, wherein the pH of the aqueous scrubbing solution is in the range of 12 to 14.

11. The method according to claim 1, further comprising directing at least some of the CNCG stream derivate from the scrubber into a sulphate pulp mill recovery boiler, thereby enabling recirculation of chemicals from the CNCG stream derivate into a chemical recovery cycle of the sulphate pulp mill.

12. The method according to claim 1, further comprising directing at least some of the gas stream from the bioreactor into a sulphate pulp mill recovery boiler, thereby enabling recirculation of chemicals from the gas stream into a chemical recovery cycle of the sulphate pulp mill.

13. A system configured to adjust S/Na-balance of a sulphate pulp mill, the system comprising:

one or more conduits connected to a sulphate pulp mill producing a pulp mill CNCG stream containing sulphur compounds and a gas comprising weak malodorous gas, the one or more conduits feeding the pulp mill CNCG stream containing sulphur compounds from the sulphate pulp mill into a scrubber, the scrubber being configured to separate sulphur compounds from the pulp mill CNCG stream with an aqueous scrubbing solution containing an alkaline agent, thereby producing a CNCG stream derivate and an aqueous spent scrubbing solution containing sulphides, a bioreactor located downstream of the scrubber, the bioreactor being configured to oxidize the aqueous spent scrubbing solution with sulphur-oxidizing microbes, thereby producing an aqueous suspension containing elemental sulphur, a sulphur separation unit located downstream of the bioreactor, the sulphur separation unit being configured to produce a residual solution and a precipitate containing the elemental sulphur from the aqueous suspension, and at least one conduit connected to the sulphate pulp mill to direct the gas comprising the weak malodorous gas from the sulphate pulp mill to the bioreactor, the at least one conduit being configured to aerate the bioreactor with the gas comprising the weak malodorous gas from the pulp mill.

14. The system according to claim 13, the system further comprising a further conduit configured to recirculate at least some of the residual solution, from which the precipitate has been separated, into the scrubber for replenishing the aqueous scrubbing solution.

15. The system according to claim 13, the system further comprising a pump and a conduit configured to direct at least some of the aqueous spent scrubbing solution back into the scrubber for re-scrubbing.

16. The system according to claim 13, the system comprising more than one bioreactor.

17. The system according to claim 13, further comprising at least one conduit connected to a recovery boiler of the sulphate pulp mill to direct CNCG stream derivate from the scrubber into the recovery boiler, thereby enabling recirculation of chemicals from the CNCG stream derivate into a chemical recovery cycle of the sulphate pulp mill.

18. The system according to claim 13, further comprising at least one conduit connected to a recovery boiler of the sulphate pulp mill to direct gas stream from the bioreactor into the recovery boiler, thereby enabling recirculation of chemicals from the gas stream into a chemical recovery cycle of the sulphate pulp mill.

* * * * *